US005209039A

United States Patent [19]

Boeshart

[11] Patent Number: 5,209,039

[45] Date of Patent: May 11, 1993

[54] APPARATUS FOR INTERCONNECTING CONCRETE WALL FORMS

[76] Inventor: Patrick E. Boeshart, R.R. 1, Box 134, Sioux City, Iowa 51108

[21] Appl. No.: 866,443

[22] Filed: Apr. 10, 1992

[51] Int. Cl.[5] ..... E04C 1/38

[52] U.S. Cl. ..... 52/699; 52/462; 52/562; 249/40; 249/216; 249/218; 249/219.2

[58] Field of Search ..... 52/699, 462, 562; 249/40, 216, 218, 219.2

[56] References Cited

U.S. PATENT DOCUMENTS

| | | | |
|---|---|---|---|
| 1,729,807 | 10/1929 | Toogood | 249/216 |
| 3,069,743 | 12/1962 | Luyben | 249/218 |
| 4,234,156 | 11/1980 | Wepf | 249/216 X |
| 4,765,109 | 8/1988 | Boeshart | 52/426 |
| 4,889,310 | 12/1989 | Boeshart | 52/426 X |
| 4,936,540 | 6/1990 | Boeshart | 52/562 X |
| 4,938,449 | 7/1990 | Boeshart | 52/562 X |
| 5,140,794 | 8/1992 | Miller | 52/426 X |

*Primary Examiner*—Richard E. Chilcot, Jr.
*Assistant Examiner*—Beth A. Aubrey
*Attorney, Agent, or Firm*—Zarley, McKee, Thomte, Voorhees & Sease

[57] ABSTRACT

An apparatus for interconnecting a pair of spaced-apart form panels includes a tie having opposing ends inserted through apertures in the panels, and retainer plates on each end to lock the panels in position. Each tie includes an elongated strap having an expanded lug at each end to prevent movement of the panel inwardly past the lug. A loop member is mounted on each lug which projects outwardly through the panel and which will receive the retainer plate to lock the panel in position on each end of the strap. The retainer plate has an aperture therethrough and a finger extending downwardly into the aperture. The retainer plate finger is journaled through the loop of the strap to lock the retainer plate onto the strap end to hold the form panel in position.

8 Claims, 5 Drawing Sheets

APPARATUS FOR INTERCONNECTING CONCRETE WALL FORMS

TECHNICAL FIELD

This invention relates generally to ties for poured concrete wall systems, and more particularly to an improved tie and tie plate which will interconnect the parallel form panels of a concrete wall system.

BACKGROUND OF THE INVENTION

While wall forming systems have been in use for many years, a relatively recent development in this industry is in the use of polystyrene insulation panels as forms for the poured concrete walls. After the poured concrete within the forms has hardened, the insulation panels may be left in position on the walls to serve as permanent insulation, or they may be stripped off to reveal the exposed concrete.

Upon introduction of this new wall forming system, it was found that it was unnecessary to use small "building blocks" to create a system of form panels for the poured concrete. Rather, larger and larger panels are now being utilized to create the concrete forms. As the panels grew in size, the applicant herein devised several new types of ties, described in U.S. Pat. No. 4,765,109, which had special ends that could be "knocked off" to easily remove the large panels from the walls. While the patented tie has proven successful for its intended purpose, there are various instances where a different kind of tie would be more convenient and useful.

One problem with the previous tie design was in situations where a large 4'×8' panel was desired to be used as the forming structure. Because the original ties were designed to fit in slots in the upper or lower edges, it was not possible to insert a tie intermediate the edges of the panel.

Another problem with prior art forming systems was in the use of ties which would retain the insulation panel permanently on the wall. Such systems were not capable of use on those occasions where an exposed concrete surface is desired. In such instances, it was necessary to revert to the older methods of wooden forms which could be removed from the wall, but which left markings on the concrete wall which remained. While the applicant's previous tie design of U.S. Pat. No. 4,765,109 solved many of these problems in the use of its "knock off ends", those ties could not be utilized in any location other than the edges of the panel. Thus, it would be desirable to create a tie having removable and reusable end pieces for use in intermediate locations on the form panel.

A further problem in the prior art was in the use of wales to support the form panel system. Typically, such wales were bulky systems which had to be supported on their own against the wall, and which required a large number of ties and other materials to install and remove. Not only is the time loss considerable, but it is necessary to utilize a large number of materials and tools which must be carried by the construction crew from site to site.

The applicant devised two improvements to the original tie, which are described in U.S. Pat. Nos. 4,936,540 and 4,938,449. While these newer ties solved many of the problems with the prior art tie and forming system, they also had several drawbacks. First, the end tie plate used with the tie was relatively complicated and expensive to manufacture. Second, the portion of the tie designed to receive a wale did not have the ultimate strength desired for the desired uses. Finally, the protruding ends of the ties permitted undesirable twisting when placed under great stress from a wale.

It is therefore a general object of the present invention to provide an improved tie for use with conventional insulation panel type forms on poured concrete walls.

Another object of the present invention is to provide a tie which can be inserted through the intermediate portion of an insulation panel form to retain the form panel in position.

A further object is to provide a concrete wall form tie which has removable end pieces for retaining the panel in position.

Still another object of the present invention is to provide a concrete form panel tie which has reusable end pieces for retaining the panels in position.

Yet another object is to provide a form panel tie with ends designed to prevent twisting when placed under pressure from a wale.

Still another object of the present invention is to provide a tie with a reusable end piece which locks in position to retain the form panel in place.

These and other objects of the present invention will be apparent to those skilled in the art.

SUMMARY OF THE INVENTION

The apparatus for interconnecting a pair of spaced-apart form panels of the present invention includes a tie having opposing ends inserted through apertures in the panels, and retainer plates on each end to lock the panels in position. Each tie includes an elongated strap having an expanded lug at each end to prevent movement of the panel inwardly past the lug. A loop member is mounted on each lug so as to project outwardly through the panel which will receive the retainer plate to lock the panel in position on each end of the strap. The retainer plate has an aperture therethrough and a finger extending downwardly into the aperture. The retainer plate finger is journaled through the loop of the strap to lock the retainer plate onto the strap end to hold the form panel in position. In a second embodiment of the invention, each lug is generally cone-shaped and formed of a solid piece of plastic, and the loop member legs are of sufficiently small diameter to permit removal from the face of the lugs. The solid body of the lug permits a threaded screw or the like to be secured therein.

DESCRIPTION OF THE PREFERRED EMBODIMENT

Figure 1:
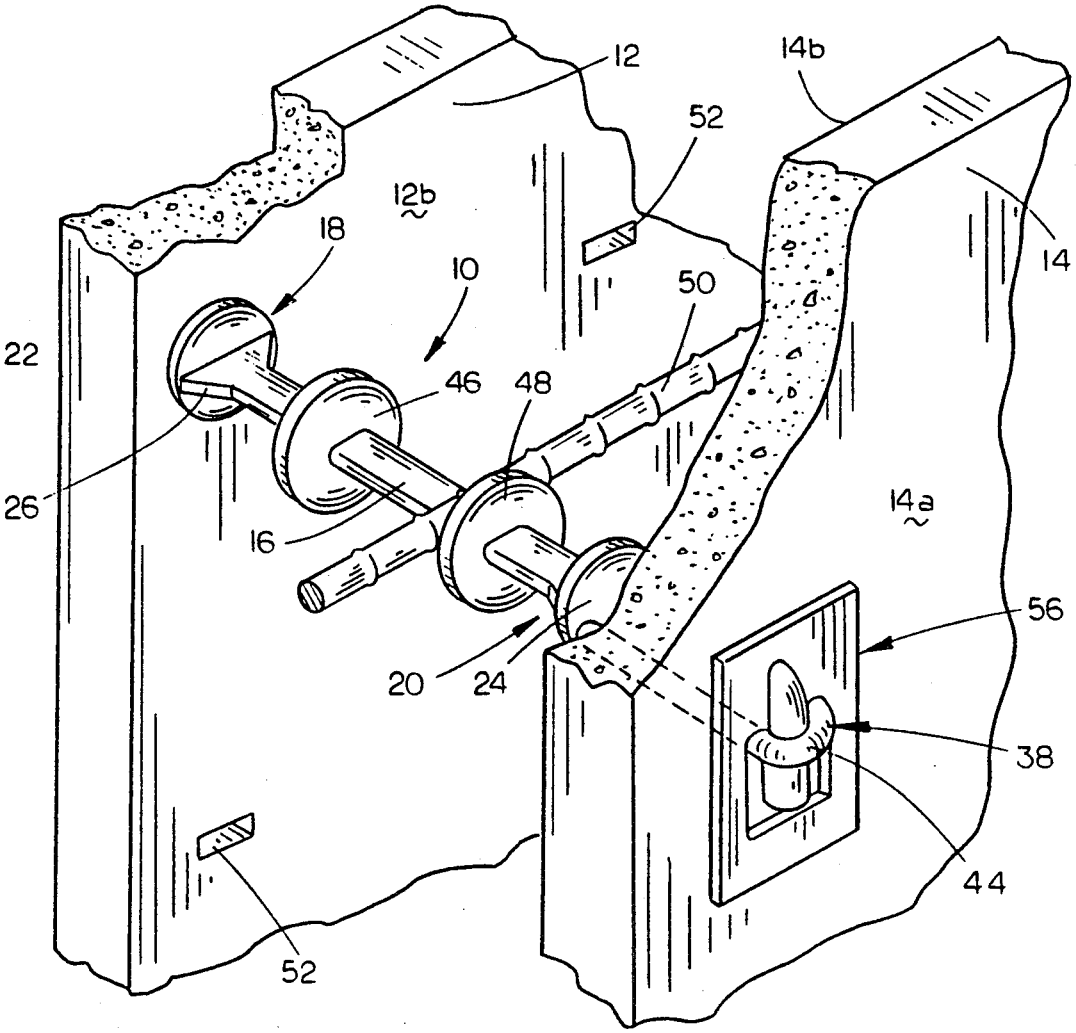
FIG. 1 is a perspective view of the tie of the present invention installed between a pair of form panels.

Referring now to the drawings, in which similar or corresponding parts are designated with the same reference numeral throughout the drawings, and more particularly to FIG. 1, the tie of the present invention is designated generally at 10 and is shown installed between a pair of vertically oriented, parallel insulation panels 12 and 14 which serve as form panels for a poured concrete wall.

Figure 2:
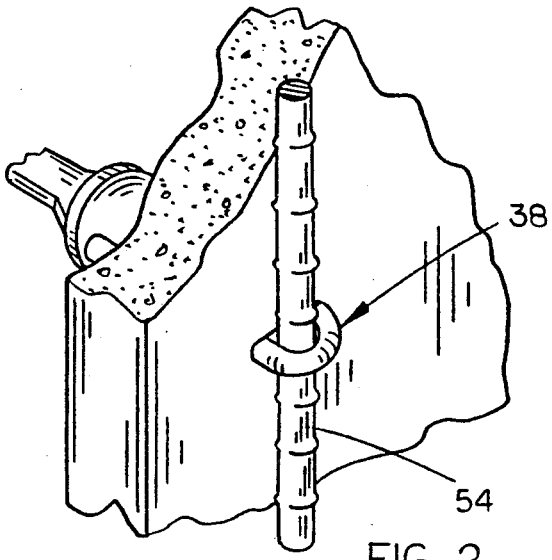
FIG. 2 is a top elevational view of the tie of the present invention.
Figure 3:
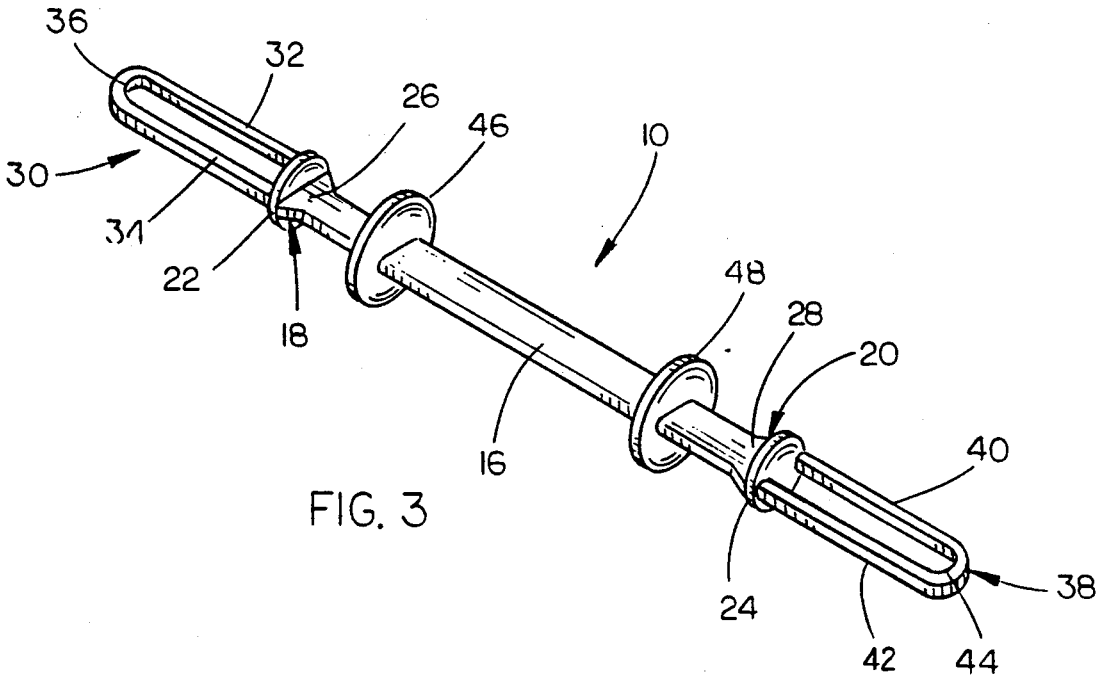
FIG. 3 is a perspective view of the tie.

Referring now to FIG. 3, tie 10 includes an elongated strap 16 having first and second opposing ends 18 and 20. Ends 18 and 20 have a generally disk-shaped lug 22 and 24 affixed thereto perpendicular to strap 16. Preferably, lugs 22 and 24 have a diameter which is greater than the width of strap 16, as shown more clearly in FIG. 2. Strap 16 has diverging portions 26 and 28 at ends 18 and 20 which widen from the width of strap 16 outwardly to the diameter of lugs 22 and 24 respectively, to thereby strengthen the connection between lugs 22 and 24 and strap 16.

A generally U-shaped end loop 30 projects outwardly perpendicularly from lug 22 and generally coplanar with strap 16. End loop 30 includes a pair of small diameter spaced-apart legs 32 and 34 extending from lug 22 and connected by an arcuate base portion 36, to form the U-shape. The second end loop 38 is mounted on lug 24 and also includes a pair of small diameter legs 40 and 42 and arcuate base portion 44.

A pair of large diameter disks 46 and 48 are mounted along strap 16 intermediate and parallel to lugs 22 and 24. Disks 46 and 48 serve to automatically align vertical and horizontal reinforcing bar between the panels 12 and 14, as shown in FIG. 1.

In assembling form panels 12 and 14, a plurality of apertures 52 are formed in each panel 12 and 14 to receive the associated end loop 30 or 38 of a tie 10. In many instances, the strength of end loops 30 and 38 permit the end loops to be pushed directly through the panel 12 and 14 without necessarily requiring the formation of an aperture 52. End loops 30 and 38 are of a length slightly greater than the thickness of form panels 12 and 14, such that these portions 36 (not shown) and 44 will project beyond the exterior surface 12*a* (not shown) and 14*a* of panels 12 and 14. Lugs 22 and 24 will contact the interior surface 12*b* and 14*b*, to hold form panels 12 and 14 in the appropriate spacing. Panels 12 and 14 may then be locked in place by inserting a wale 54 (see FIG. 2) through a series of vertically aligned end loops 38, or utilizing a locking retainer plate 56 (as shown in FIG. 1).

Figure 4:
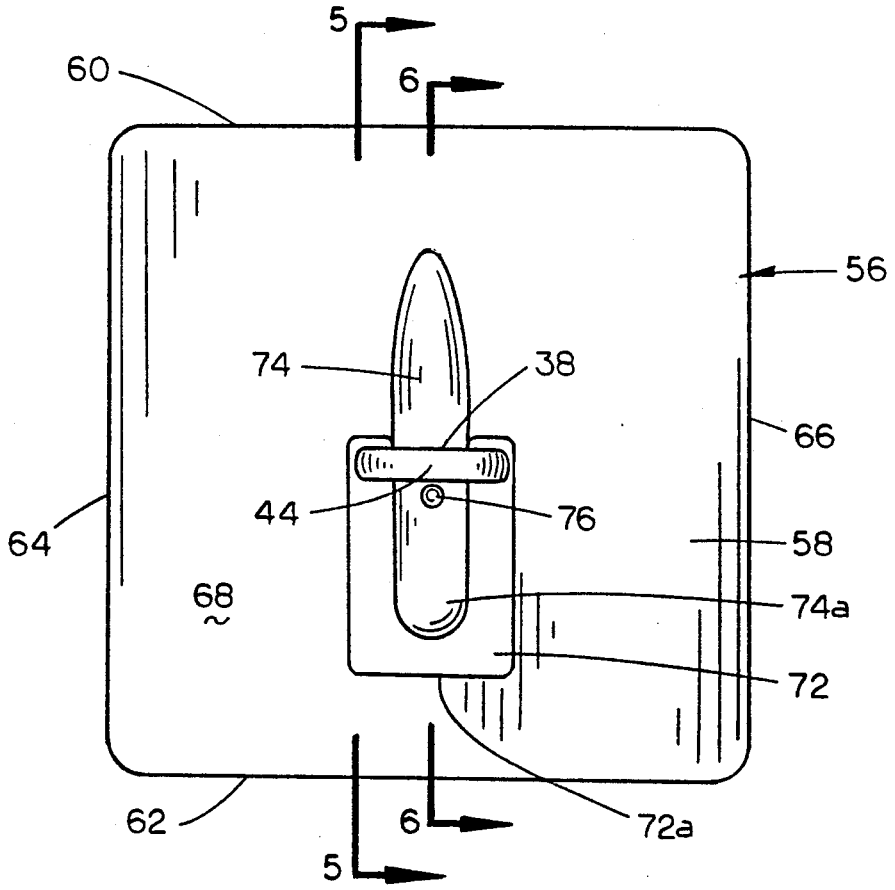
FIG. 4 is a front elevational view of the retaining plate of the present invention.
Figure 6:
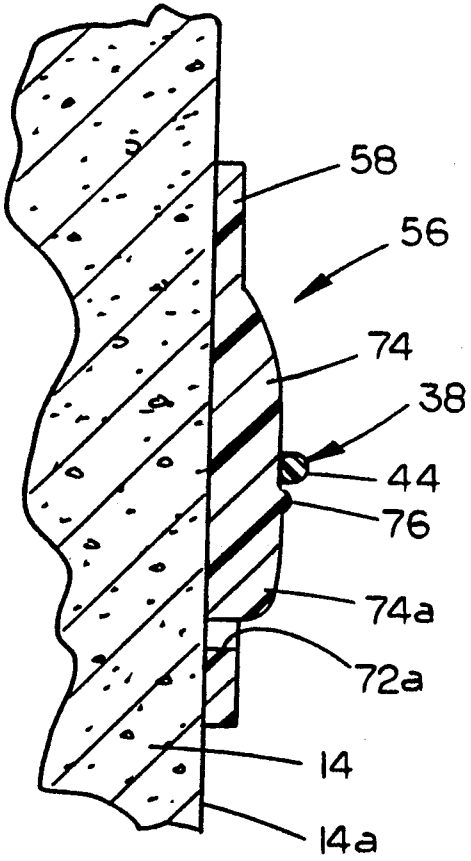
FIG. 6 is a sectional view taken at lines 6—6 in FIG. 4.
Figure 5:
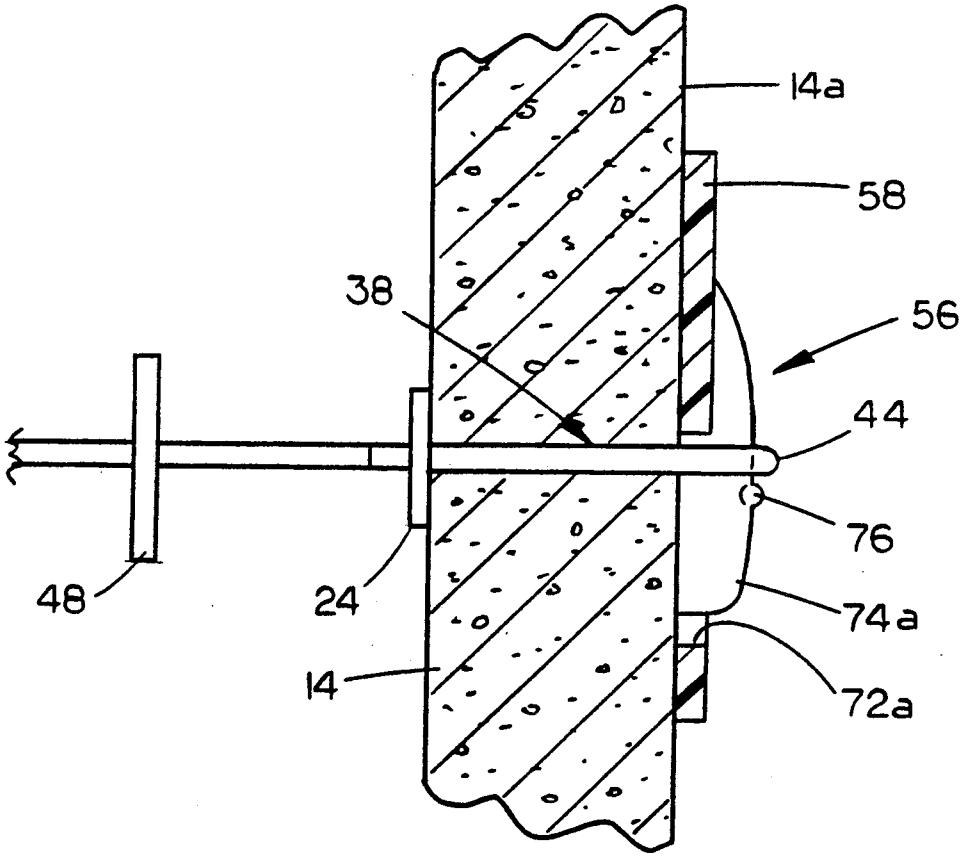
FIG. 5 is a sectional view taken at lines 5—5 in FIG. 4.

Referring now to FIG. 4, a locking retainer plate is designated generally at 56 and is preferably formed of nylon or a similar plastic material. Retainer plate 56 includes a generally square base plate 58 having an upper edge 60, lower edge 62, opposing side edges 64 and 66, a forward surface 68 and rearward surface 70. An aperture 72 is formed through base plate 58 and located generally centrally in the lower half of the front surface 68. A finger 74 projects forwardly from the front surface 68 of base plate 58, and projects downwardly into aperture 72. The depending end 74*a* is spaced above the lower edge 72*a* of aperture 72, a distance greater than the thickness of end loop 38, such that base portion 44 of end loop 38 will pass between depending end 74*a* of finger 74 and lower edge 72*a* of aperture 72. In this way, a finger 74 may be journaled through end loop 38 to lock a panel in position on tie 10, as shown in FIG. 1.

A small projecting button 76 is formed on the forward surface of finger 74 and is located so as to retain end loop 38 thereabove when finger 74 is positioned through end loop 38. Button 76 projects a distance slightly greater than the distance between the interior directed surface of base portion 44 and the exterior surface of 14*a* of 14, such that a dynamic force must be applied to the upper edge 60 of plate 58 to cause finger 74 to be locked into position on end loop 38. In this fashion, button 76 will retain retainer plate 56 in the desired location to prevent accidental removable thereof. A similar dynamic force must be applied to lower edge 62 of plate 58 to disengage retainer plate 56 from end loop 38.

Figure 7:
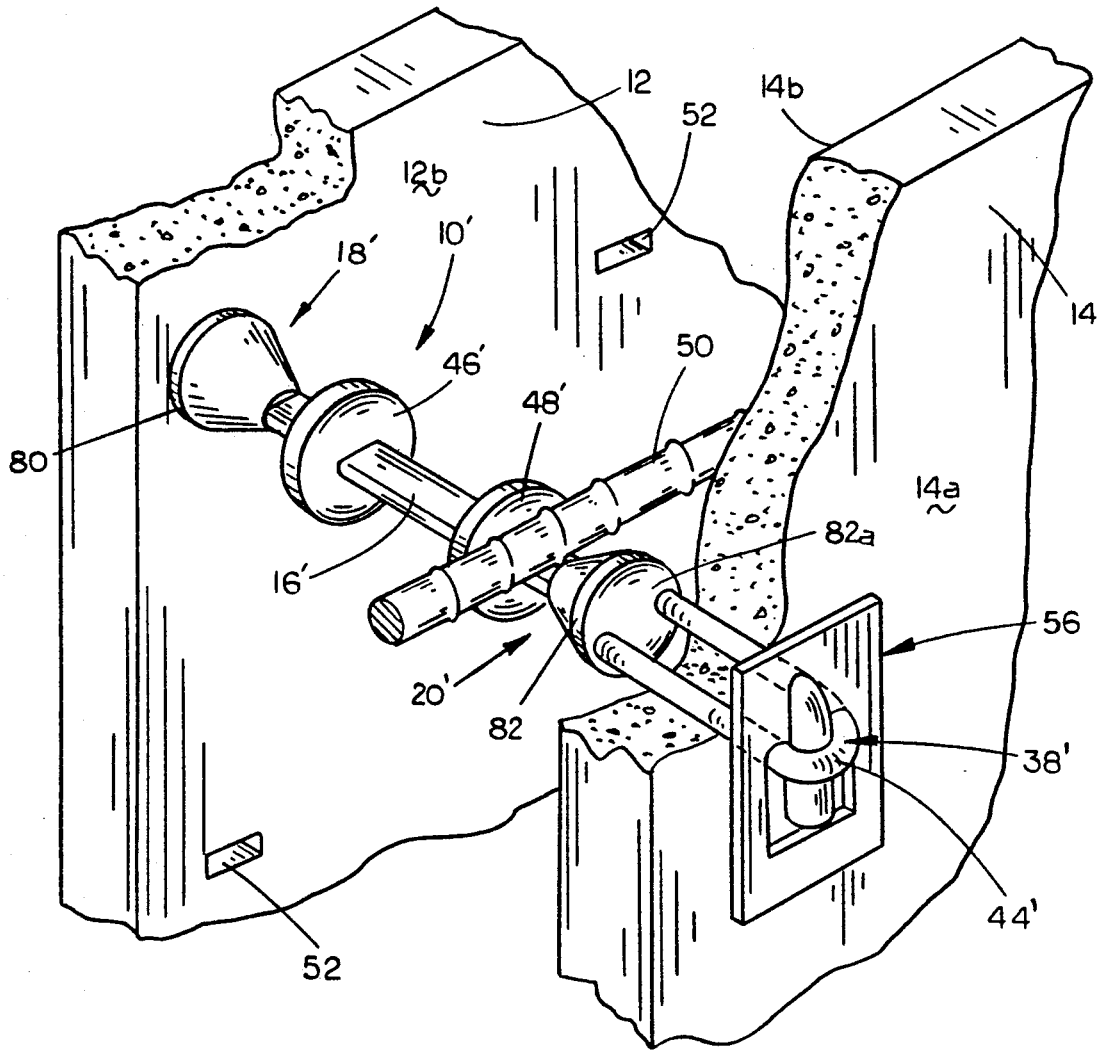
FIG. 7 is a perspective view of a second embodiment of the tie installed between a pair of form panels.
Figure 9:
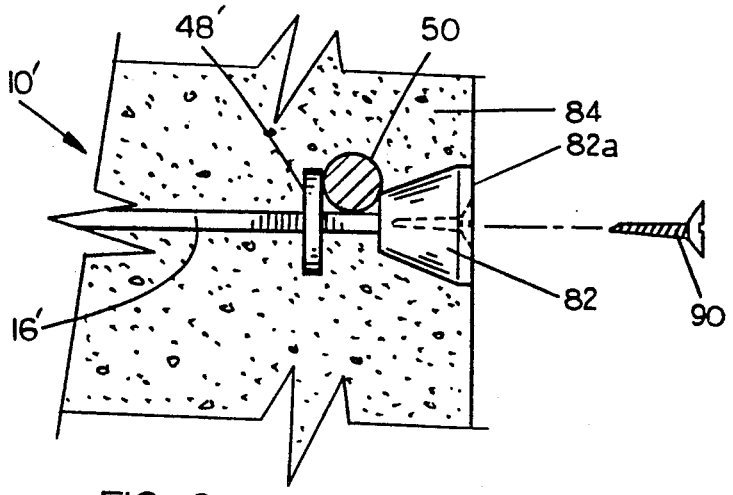
FIG. 9 is a partial sectional view through a portion of the wall of FIG. 8.

Referring now to FIG. 7, a second embodiment of the invention is identified generally at 10′ and is shown installed between a pair of form panels 12 and 14. Tie 10′ includes an elongated strap 16′ having first and second opposing ends 18′ and 20′. Ends 18′ and 20′ have a generally cone-shaped lug 80 and 82 affixed thereto with the base 80*a* and 82*a* of each cone 80 and 82 oriented perpendicularly and outwardly from each end of strap 16′. Cones 80 and 82 serve a number of purposes. First, the shape strengthens the connection between end loops 30′ and 38′ and strap 16′. Second, the shape of cones 80 and 82 positions reinforcing bar 50 in the appropriate location spaced from form panels 12 and/or 14. In this way, reinforcing rod 50 will be spaced an appropriate distance from the surface of the concrete wall, as shown in FIG. 9. Finally, the bases 80*a* and 82*a* of cones 80 and 82 provide a surface into which a screw or other fastener 90 (as shown in FIG. 9) may be fastened after removal of the form panels 12 and/or 14.

Ties 10′ include the same end loops 30 and 38, as described with respect to the first embodiment of the tie 10. As discussed hereinabove, end loops 30′ and 38′ have small diameter legs, for a purpose described in more detail hereinbelow.

Figure 8:
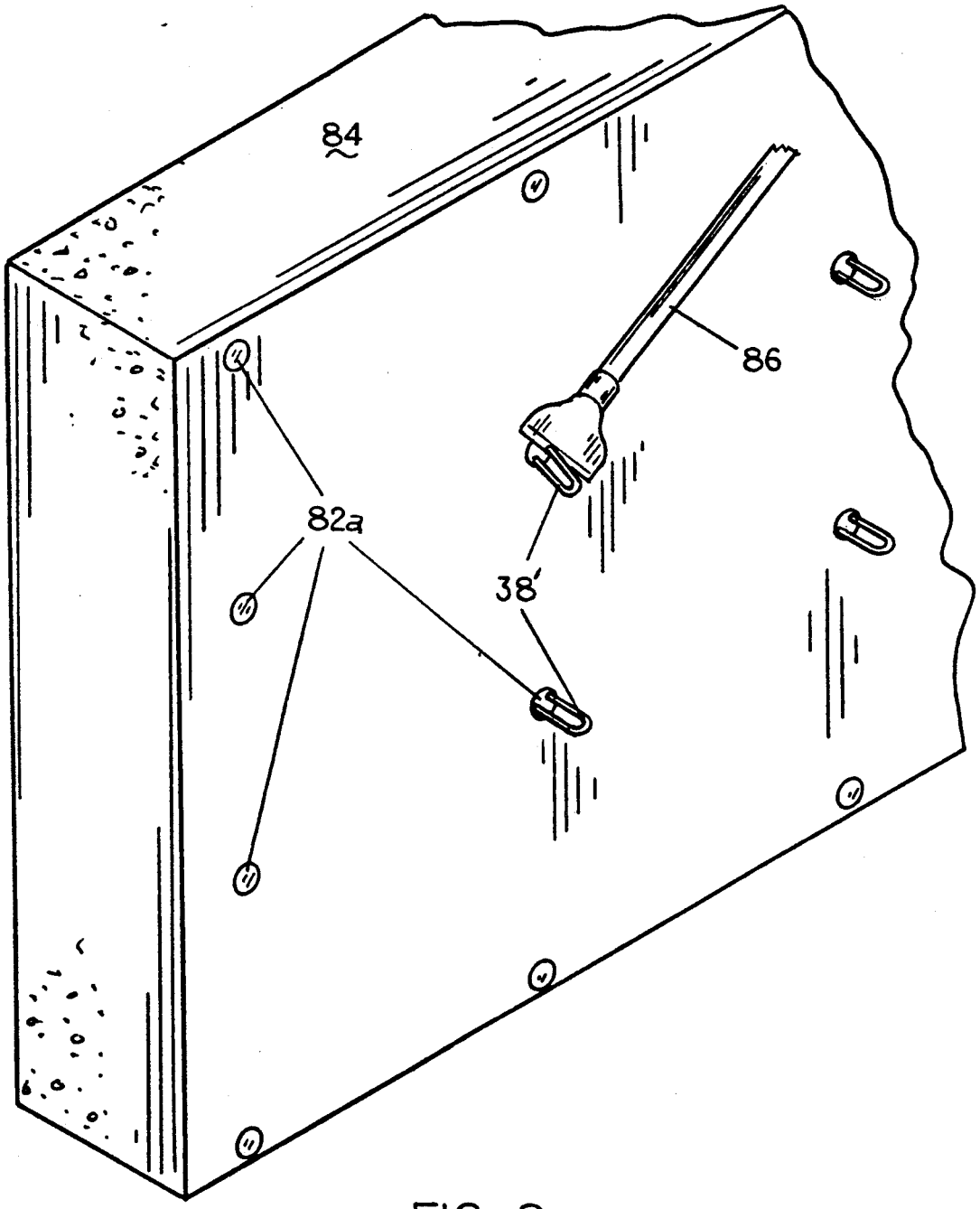
FIG. 8 is a perspective view of a concrete wall with the retainer plates and form panels removed therefrom.

In those locations where the insulation of the form panels 12 and/or 14 is not desired or required, retainer plates 56 may be removed, so as to permit the removal of the associated form panels. Once the form panels have been removed, the U-shaped end loops 30′ and 38′ will project outwardly from the concrete wall 84, as shown in FIG. 8. A conventional ice scraper 86 or the like may be utilized to quickly and easily remove end loops 38′ so as to leave the base 82*a* flush with the vertical face of wall 84. A screw or fastener 90 may then be fastened into cone 82 to secure a desired material to the concrete wall 84.

Whereas the invention has been shown and described in connection with the preferred embodiment thereof, it will be understood that many modifications, substitutions and additions may be made which are within the intended broad scope of the appended claims. There has therefore been shown and described an improved apparatus for connecting concrete form panels which accomplishes at least all of the above stated objects.

I claim:

1. Apparatus for interconnecting a pair of spaced-apart form panels, comprising:

an elongated strap having first and second opposite ends;

stop means on said first and second ends, for preventing movement of said panels inwardly towards one another along said strap;

wale receiving means on said first and second ends, extending outwardly from said stop means, for receiving a wale to prevent outward movement of panels on said first and second ends;

said wale receiving means including an aperture formed in each said end;

wale means removable connected to each said end through said apertures, for preventing movement of said panels outwardly; said wale receiving means including:

a first loop having a pair of legs extending outwardly from said stop means on said first end, and a base portion connecting said pair of legs, to form a first aperture between said first loop legs, the first end stop means and the base portion; and a second loop having a pair of legs extending outwardly from said second end stop means, and a base portion connecting said pair of legs, to form a second aperture between said second loop legs, the second end stop means, and the second base portion.

2. Apparatus for interconnecting a pair of spaced-apart form panels, comprising:

an elongated strap having first and second opposite ends;

stop means on said first and second ends, for preventing movement of said panels inwardly towards one another along said strap;

wale receiving means on said first and second ends, extending outwardly from said stop means, for receiving a wale to prevent outward movement of panels on said first and second ends;

said wale receiving means including an aperture formed in each said end;

wale means removably connected to each said end through said apertures, for preventing movement of said panels outwardly;

said stop means including a first lug on the first end of said strap having a greater diameter than said strap, a second lug on the second end of said strap;

said first loop legs extending outwardly from said first lug to form said first aperture; and said second loop legs extending outwardly from said second lug to form said second aperture.

3. The apparatus of claim 2, wherein each lug is a generally disk-shaped member oriented perpendicularly to said strap end wherein said strap includes:

a first diverging portion connected to said first lug, wherein the width of the strap increases so as to diverge proximal to its connection with the first lug; and a second diverging portion connected to said second lug, wherein the width of the strap increases so as to diverge proximal to its connection with the second lug.

4. The apparatus of claim 2, wherein each said lug is generally cone-shaped and solid, with a flat base portion oriented perpendicularly and outwardly from the strap, and wherein said end loop legs are connected to said flat base portions of said first and second lugs.

5. The apparatus of claim 4, further comprising first and second disks mounted on said strap and oriented perpendicularly to said strap, the first disk spaced inwardly from the first cone and the second disk spaced inwardly from the second cone, said first and second disks located to position a reinforcing bar between the disk and the respective cone at a predetermined location relative to the base portion of the respective cone.

6. Apparatus for interconnecting a pair of spaced-apart form panels, comprising:

an elongated strap having first and second opposite ends;

stop means on said first and second ends, for preventing movement of said panels inwardly towards one another along said strap;

wale receiving means on said first and second ends, extending outwardly from said stop means, for receiving a wale to prevent outward movement of panels on said first and second ends;

said wale receiving means including an aperture formed in each said end;

wale means removably connected to each said end through said apertures, for preventing movement of said panels outwardly; said wale means including:

a retainer plate having an aperture therethrough through which a portion of said wale receiving means projects; and a rigid finger mounted on said plate and projecting downwardly into said aperture for removable connection to said projecting portion of said wale receiving means.

7. The apparatus of claim 1, wherein said wale means includes:

a first retainer plate having an aperture therethrough through which said first base portion and a portion of said first pair of legs of said loop, project;

a first rigid finger mounted on said first plate projecting downwardly into said first plate aperture and journaled through the projecting portion of said first loop aperture;

a second retainer plate having an aperture therethrough through which the second base portion and a portion of the second pair of legs of said second loop, project; and a second rigid finger mounted on said second plate projecting downwardly into said second plate aperture, journaled through said second loop aperture.

8. The apparatus of claim 5, wherein said first and second rigid fingers each further include an outwardly projecting button located on said fingers to selectively retain the projecting end of said first and second loops on said fingers, said buttons projecting a distance outwardly slightly greater than the length of the associated aperture in said first and second loops, such that said first and second loops must be biased outwardly to pass over said buttons.

* * * * *